US007163774B2

(12) United States Patent
Shiraishi et al.

(10) Patent No.: US 7,163,774 B2
(45) Date of Patent: Jan. 16, 2007

(54) TONER FOR FORMING IMAGE, METHOD FOR DEVELOPING ELECTROSTATIC LATENT IMAGE, METHOD FOR FIXING TONER IMAGE, IMAGE FORMING METHOD AND PROCESS CARTRIDGE USING THE TONER

(75) Inventors: Keiko Shiraishi, Susono (JP); Toyoshi Sawada, Odawara (JP); Masashi Nagayama, Numazu (JP); Shinichi Kuramoto, Numazu (JP); Mitsuo Aoki, Numazu (JP); Kumi Hasegawa, Numazu (JP); Bing Shu, Mishima (JP)

(73) Assignee: Ricoh Company Limited, Tokyo (JP)

( * ) Notice: Subject to any disclaimer, the term of this patent is extended or adjusted under 35 U.S.C. 154(b) by 190 days.

(21) Appl. No.: 10/772,435

(22) Filed: Feb. 6, 2004

(65) Prior Publication Data

US 2004/0157147 A1 Aug. 12, 2004

(30) Foreign Application Priority Data

Feb. 10, 2003 (JP) ..... 2003-032687

(51) Int. Cl.
*G03G 9/09* (2006.01)

(52) U.S. Cl. ..... 430/109.4; 430/108.6; 430/120

(58) Field of Classification Search ..... 430/109.4, 430/108.6, 120
See application file for complete search history.

(56) References Cited

U.S. PATENT DOCUMENTS

| | | | | |
|---|---|---|---|---|
| 6,566,026 | B1 | 5/2003 | Watanabe et al. | |
| 6,593,048 | B1 | 7/2003 | Sasaki et al. | |
| 6,653,037 | B1 | 11/2003 | Sawada et al. | |
| 6,660,443 | B1 | 12/2003 | Sugiyama et al. | |
| 6,821,698 | B1 * | 11/2004 | Sawada et al. | 430/108.4 |
| 2002/0132177 | A1 * | 9/2002 | Sawada et al. | 430/106.2 |
| 2003/0036010 | A1 | 2/2003 | Suzuki et al. | |

FOREIGN PATENT DOCUMENTS

| | | |
|---|---|---|
| JP | 2002-108018 | 4/2002 |
| JP | 2003-167384 | 6/2003 |

* cited by examiner

*Primary Examiner*—John L Goodrow
(74) *Attorney, Agent, or Firm*—Oblon, Spivak, McClelland, Maier & Neustadt, P.C.

(57) ABSTRACT

A toner including a binder resin including a crystalline polyester and a non-crystalline resin; a release agent; and a black metal-containing material having a saturation magnetization not greater than 50 emu/g. A toner container containing the toner. A fixing method including passing a support with the toner image thereon through a nip between two cylindrical rollers while applying a pressure not greater than $1\times10^5$ Pa to the two cylindrical rollers, wherein one of the cylindrical rollers which contacts the toner image has a thickness not greater than 1.0 mm. An image forming method including developing an electrostatic image with the toner to form a toner image; transferring the toner image onto a receiving material; and fixing the toner image by the fixing method mentioned above. A process cartridge including an image bearing member and a developing device using the toner.

49 Claims, 3 Drawing Sheets

TONER FOR FORMING IMAGE, METHOD FOR DEVELOPING ELECTROSTATIC LATENT IMAGE, METHOD FOR FIXING TONER IMAGE, IMAGE FORMING METHOD AND PROCESS CARTRIDGE USING THE TONER

BACKGROUND OF THE INVENTION

1. Field of the Invention

The present invention relates to a toner for use in developing an electrostatic latent image. In addition, the present invention also relates to a method for developing an electrostatic latent image, a method for fixing a toner image, an image forming method using the toner and a process cartridge using the toner.

2. Discussion of the Background

Among the methods for fixing toner images upon application of heat thereto, methods using a heat roller are widely used because of having good energy efficiency. Recently, the heat energy used for fixing toner images becomes smaller and smaller to fix toner images at a low temperature, i.e., to save energy. In addition, it is needed to decrease the warm-up time of an image forming apparatus, while the electric power consumption of the apparatus is minimized in the waiting state to protect environment. Requirements for next generation image forming apparatuses are described in the DSM (Demand-side Management) program of IEA (International Energy Agency). There are several requirements therein such that the warm-up time should not be greater than 10 seconds and the power consumption in a waiting state should be not greater than 10 to 30 watt (which changes depending on the copying speed) in copiers having a copy speed not less than 30 cpm (copies per minutes). In order to fulfill these requirements, the power consumption of copiers must be dramatically reduced.

In attempting to fulfill the requirements, fixing devices using a fixing element, such as heat rollers, which has a low thermal capacity and which has a quick temperature rising property, have been studied. However, the devices do not bring about desirable effects.

Therefore, it is essential for fulfilling the requirements to develop a toner which can be fixed at a low temperature, i.e., which can be used in an image forming apparatus performing fixing at a relatively low temperature.

In attempting to develop a toner having a low temperature fixability, techniques such that a specific non-olefin type crystalline polymer or a specific crystalline polyester resin, which has a sharp melting property at its glass transition temperature (Tg) such that the resin not only changes its crystal form at Tg but also changes its state from a solid state to a liquid state (i.e., decreases its viscosity), is included in the binder resin have been disclosed.

However, when such a resin having a sharp melting property is kneaded together with other toner constituents, such as colorants and release agents, to prepare a toner, the melt viscosity of the kneaded mixture seriously decreases, thereby causing a problem in that the colorants and release agents cannot be finely dispersed. When colorants are not well dispersed, problems occur in that high density images cannot be produced and clear images cannot be produced in color image production. In this case, when the colorants are materials having a low resistivity, such as carbon black, the resultant toner also has a low resistivity, thereby causing problems in that the resultant toner images have background fouling (due to deterioration of the developing property of the toner) and uneven density in solid images (due to deterioration of the transfer property of the toner).

When the release agents are not well dispersed, the release agents tend to present on the surface of the resultant toner, thereby deteriorating the developing property of the toner, resulting in occurrence of the background fouling problem. In addition, such toners contaminate the carriers which are used together with the toners to prepare two-component developers and/or charging rollers or blades, and thereby the life of such image forming members is shortened.

With respect to the techniques in which a crystalline resin is included in the binder resin, crystalline resins hardly disperse colorants, and thereby the above-mentioned problems tend to occur. In addition, crystalline resins are typically insoluble in resins which are generally used as the toner binder resin. Therefore, even when a crystalline resin is used in combination with a resin which is used as the toner binder, problems in that the colorant used together with the crystalline resin and the binder resin cannot be well dispersed in the resins because the colorant such as carbon blacks and pigments is not included in the crystalline resin (i.e., the colorant is selectively included in the binder resin).

Recently, the particle diameter of toner becomes smaller and smaller to produce high quality toner images. When toner constituents are not well dispersed in such a toner having a small particle diameter, the above-mentioned problems caused by the uneven dispersion becomes more serious.

In addition, when a polyester having crystallinity is included in the polyester resin in an amount greater than a certain amount, problems which occur are that the resultant toner has poor offset resistance and preservability; and when the toner is manufactured by a pulverization method, the kneaded mixture cannot be finely pulverized. Similarly to the case where a wax serving as a release agent establishes a trade off relationship between releasability and colorant dispersing ability (i.e., a trade off relationship in that when the content of a wax is increased, the releasability of the resultant toner can be improved but the colorant dispersing ability of the toner deteriorates), the polyester resins having crystallinity establish a trade off relationship between low temperature fixability and colorant dispersing ability even when the content thereof is changed.

The present inventors have disclosed a toner which includes a crystalline polyester and which has good sharp melting property (published unexamined Japanese Patent Application No. 2003-167384). However, a need exists for a toner having a further improved low temperature fixability.

In attempting to solve the uneven dispersion problem of a crystalline resin in toner, a toner which is prepared by agglomerating a particulate resin having crystallinity and a particle size on the order of submicrons together with fine particles of other toner constituents such as non-crystalline resins and release agents is disclosed in published unexamined Japanese Patent Application No. 2002-108018. However, in order to develop the effect of such a particulate resin in the resultant toner, the particle diameter of the resin dispersed in the toner should be not less than a certain particle diameter (i.e., when the particle diameter of the resin dispersed in the toner is too small, the effect of the resin cannot be well produced). Namely, there is a trade off relationship between the particle diameter of the resin dispersed in the toner and the dispersibility thereof. Namely, there is a limit to the low temperature fixability of such a toner.

In other words, it is essential to use a technique other than the technique using a crystalline resin, to impart good low temperature fixability to a toner.

Carbon blacks have been typically used as a colorant of black toners. However, in the case of magnetic toners, the magnetic material included therein often serves as a colorant (i.e., other colorants such as carbon black are not included therein). Such a magnetic toner often has a good low temperature fixability. The reason is considered to be that the magnetic material (typically, metal-containing materials) has relatively good heat conductivity compared to carbon blacks.

Although a toner including a magnetic material can be used as a one-component developer without causing problems, such a toner has poor developability when used for a non-magnetic toner (i.e., for a two-component developer) because the attraction force between the carrier used and the toner increases. When the addition amount of the magnetic material is decreased to reduce the attraction force, the resultant toner has an insufficient low temperature fixability.

In addition, a need exists for a toner including no carbon black in view of safety.

Because of these reasons, a need exists for a toner which is safe and has such an excellent low temperature fixability as to be used for low heat capacity fixing devices without causing an offset problem and a preservation problem and which can produce good images without causing background fouling problem and a toner scattering problem in that toner particles are scattered in image forming apparatus, resulting in contamination of image forming members.

SUMMARY OF THE INVENTION

Accordingly, an object of the present invention is to provide a toner which is safe and has such an excellent low temperature fixability as to be used for low heat capacity fixing devices without causing an offset problem and a preservation problem and which can produce good images without causing background fouling problem and the toner scattering problem.

Another object of the present invention is to provide a method for developing an electrostatic latent image, a method for fixing the toner, an image forming method, and a process cartridge, by which good images without background fouling can be produced for a long period of time without causing the toner scattering problem, an offset problem and a preservation problem.

Briefly these objects and other objects of the present invention as hereinafter will become more readily apparent can be attained by a toner including at least a binder resin, a release agent, and a black metal-containing material, wherein the binder resin includes a crystalline polyester and a non-crystalline resin, and wherein the black metal-containing material has a saturation magnetization not greater than 50 emu/g.

The metal-containing material preferably has a color such that the L*, a* and b* values of the color are not greater than 15, from −1.0 to 1.0 and from −1.0 to 1.0, respectively.

The metal-containing material is preferably a titanium-containing iron oxide. The content of titanium atom is preferably from 10 to 45% by weight based on the iron atom included in the iron oxide.

The specific surface area of the metal-containing compound is preferably from 1.5 to 30 $m^2/g$.

The metal-containing material preferably has a true specific gravity of from 4.0 to 5.0.

It is preferable that the metal-containing material is included in the toner in an amount of from 10 to 50 parts by weight per 100 parts by weight of the binder resin.

The toner preferably has an X-ray diffraction spectrum such that at least a diffraction peak is observed at a Bragg (2θ) angle of from 20° to 25°.

The toner preferably has a volume average particle diameter of from 2.5 to 10 μm.

The content of the crystalline polyester is preferably not greater than 50% by weight based on the total weight of the binder resin.

The crystalline polyester preferably has a melting point of from 80 to 130° C., and an X-ray diffraction spectrum such that at least one diffraction peak is observed in each of Bragg (2θ) angle ranges of from 19° to 20°, from 21° to 22°, from 23° to 25° and from 29° to 31°. The crystalline polyester preferably has the following formula (1):

$$[—O—CO—CR_1{=}CR_2—CO—O—(CH_2)_n—]_m \quad (1)$$

wherein n and m independently represents an integer (i.e., a repeat number); and $R_1$ and $R_2$ independently represent a hydrocarbon group.

The non-crystalline resin is preferably a polyester resin. It is preferable that the non-crystalline resin has a glass transition temperature of from 40 to 70° C., and an $F_{1/2}$ temperature of from 120 to 160° C.

The release agent preferably has a melting point of from 70 to 90° C.

As another aspect of the present invention, a toner container is provided which contains the toner mentioned above.

As yet another aspect of the present invention, a method for fixing an image of the toner mentioned above formed on a support, which includes:

passing the support with the toner image thereon through a nip between two cylindrical rollers while applying a pressure not greater than $1\times10^5$ Pa to the two cylindrical rollers, wherein each of the cylindrical rollers has a thickness not greater than 1.0 mm.

As a further aspect of the present invention, a method for developing an electrostatic latent image is provided which includes:

developing an electrostatic latent image on an image bearing member with the toner mentioned above to form a toner image on the image bearing member.

As a still further aspect of the present invention, an image forming method is provided which includes:

developing an electrostatic latent image on an image bearing member with the toner mentioned above to form a toner image on the image bearing member;

transferring the toner image onto a receiving material optionally via an intermediate transfer member; and fixing the toner image on the receiving material by the fixing method mentioned above.

As a still further aspect of the present invention, a process cartridge is provided which includes a photoreceptor and a developing device configured to develop an electrostatic image on the photoreceptor with the toner of the present invention, and optionally includes a charger and/or a cleaner.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
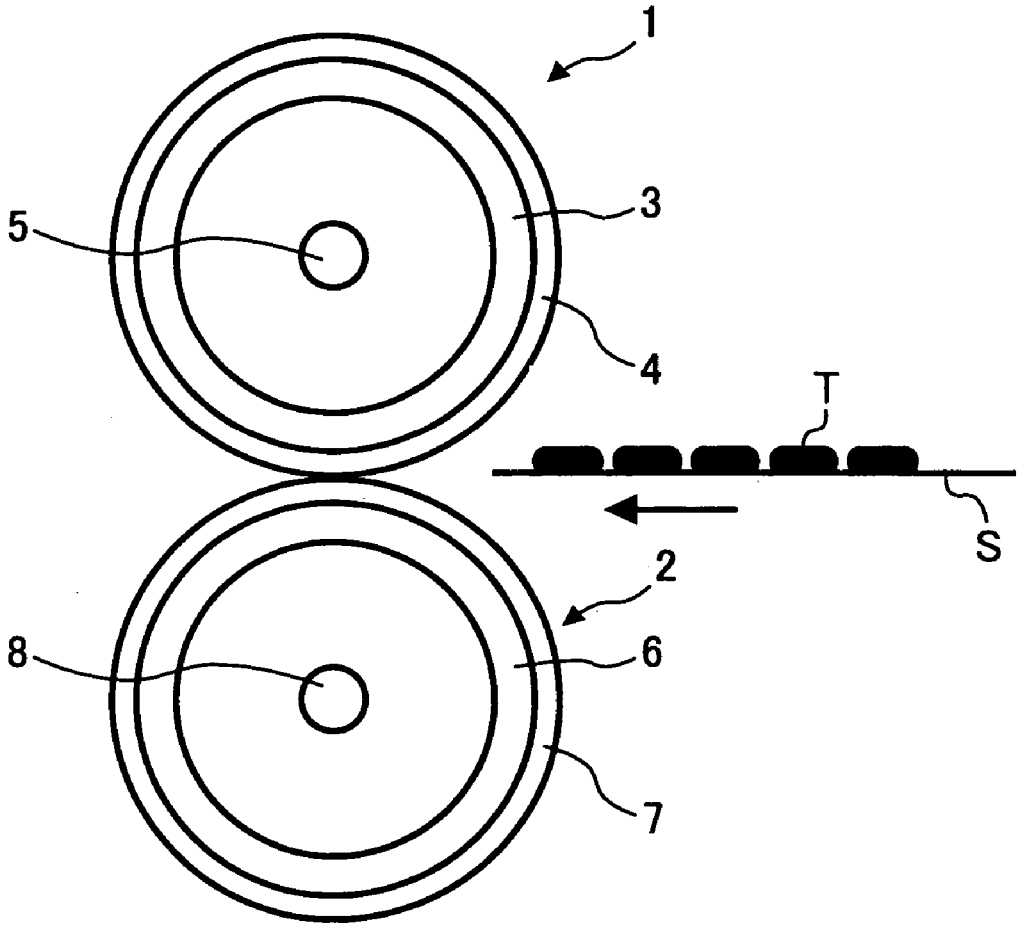
FIG. 1 is a schematic view illustrating heat rollers for use in the toner fixing method of the present invention.

As a result of the investigation of the present inventors, it is discovered that when specific metal-containing black materials, which have a good heat conductivity and a good tinting power, are used as a black colorant of a toner including a crystalline resin as a binder resin, the resultant toner has excellent low temperature fixability without deteriorating dispersion of the crystalline resin in the toner and without deteriorating the developing property of the toner. Thus, the present invention is made.

The toner of the present invention includes a crystalline polyester resin as a binder resin.

Crystalline polyester resins have a melting point, and change their crystal form at the melting point. In addition, crystalline polyester resins change their phase from a solid state to a liquid state at their melting point, and rapidly decrease their viscosity. Therefore, a toner including such a crystalline polyester resin can be securely fixed on receiving materials such as papers.

In contrast, when non-crystalline resins are heated, the resins gradually decrease their viscosity from their glass transition temperature (Tg). Therefore, in order to fix a toner including such a non-crystalline resin as a binder resin, a large amount of heat energy has to be applied to the toner to reduce the viscosity of the non-crystalline resin. In order to fix a toner including a non-crystalline resin as a binder resin at a relatively low temperature (i.e., in order to reduce the viscosity of a non-crystalline resin at a relatively low temperature), the glass transition temperature or the molecular weight of the resin has to be decreased. In these cases, preservability and hot offset resistance of the resultant toner deteriorate. When a crystalline polyester resin is added to such a toner including a non-crystalline resin as a binder resin, the melt viscosity of the toner can be decreased without deteriorating the preservability and hot offset resistance of the toner.

The lowest fixable temperature of a toner including a crystalline polyester resin mainly depends on the melting point, content and dispersion condition of the crystalline polyester resin. Namely, when the melting point of the crystalline polyester resin added is low, the content thereof is high or the dispersion condition thereof is poor (i.e., uneven), the lowest fixable temperature of the toner decreases. However, in view of the preservability and hot offset resistance of the toner, there are limitations to the melting point and the content of the crystalline polyester resin. In addition, in view of toner image qualities, there is limitation to the dispersion condition of the crystalline polyester resin.

The present inventors discover that by including a metal-containing material, which has a saturation magnetization not greater than 50 emu/g, in a toner, the lowest fixable temperature of the toner can be lowered without deteriorating the preservability, hot offset resistance and image qualities of the toner.

By using a metal-containing material having a saturation magnetization not greater than 50 emu/g, the resultant toner has a very small saturation magnetization. Therefore, when such a toner is used as a non-magnetic toner, the toner does not cause a development problem in that the developing ability of the toner deteriorates due to increase in magnetic attraction force between the toner and the developer bearing member in one-component development or between the toner and the carrier in two-component development.

In the present invention, the magnetic properties of a metal-containing material are measured using a magnetization measuring instrument, BHU-60 from Riken Electronic Co., Ltd. The measurement method is as follows:

(1) a metal-containing material is contained in a cell having an inside diameter of 7 mm and a height of 10 mm;

(2) a magnetic field is applied thereto while continuously changing the magnetic field from 0 to 10 kOe to obtain a magnetization curve of the material; and (3) the saturation magnetization, residual magnetization and coercive force of the material are determined from the magnetization curve.

In addition, the metal-containing materials for use in the toner of the present invention have a black color, and therefore the materials can serve as a heat conductive material and a black colorant. Namely, the content of carbon black in the toner, which decreases electroconductivity of the toner, can be decreased or can be reduced to zero. As a result, occurrence of the background fouling problem in that the resultant toner images have background fouling or the toner scattering problem in that the toner is scattered in a developing device and/or an image forming apparatus, which problems are caused by decrease of electroconductivity and charge maintaining ability of the toner (resulting in deterioration of charging property and increase in quantity of reversely-charged toner particles or weakly-charged toner particles), can be prevented. In addition, in view of safety, it is preferable to use such a metal-containing material because the content of carbon black in a toner can be decreased.

Suitable metal-containing materials for use as the black colorant of the toner of the present invention include metal-containing materials such as hematite and magnetite, which preferably include a compound such as compounds having an element such as Mn, Ti, Cu, Si and C, oxides of the elements, and mixture thereof.

The black-colored metal-containing materials for use in the toner of the present invention satisfy the requirements for black color defined in CIE 1976 (L* a* b*) chromaticness, i.e., $L^* \leqq 20$, $-2.0 \leqq a^* \leqq +3.5$, and $-2.0 \leqq b^* \leqq +3.5$. The black-colored metal-containing materials for use in the toner of the present invention preferably satisfy the following relationships:

$L^* \leqq 15$, $-1.0 < a^* \leqq +1.0$, and $-1.0 \leqq b^* \leqq +1.0$.

Addition of such a metal-containing material imparts high blackness to the resultant toner.

In the present application, the L*, a* and b* values of a material are determined by measuring the chromaticness (C*) of the material using a spectrodensitometer X-Rite 938 from X-Rite. The measurement method are as follows:

(1) at first, 0.5 g of the powder of a black pigment to be measured is mixed with 1.0 ml of castor oil and the mixture is kneaded with a Hoover automatic muller to prepare a paste;
(2) then 4.5 g of a clear lacquer is mixed with the paste, followed by kneading to prepare a coating liquid;
(3) the coating liquid is coated on a cast-coated paper using an applicator with a gap of 6 mil to form a coated layer with a thickness of 6 mil on a wet basis;
(4) the coated liquid is dried to prepare a layer; and
(5) L*, a* and b* values of the layer are determined by measuring the chromaticness (C*) of the material using a spectrodensitometer X-Rite 938 from X-Rite.

Among the black pigments mentioned above, iron oxide compounds including titanium are preferably used in the present invention because of capable of being prepared without using a PRTR (Pollutant Release and Transfer Register) material (i.e., because of being environmentally friendly). The titanium-containing iron oxides preferably polycrystalline particles including a solid solution having a formula $Fe_2O_3$—$FeTiO_3$ because the material is a non-magnetic material having a black color.

The weight ratio (Ti/Fe) of Ti atom to Fe atom in the material is preferably from 10/100 to 45/100. When the weight ratio is too small, the black pigment has too large a magnetization. In contrast, when the weight ratio is too large, the black pigment has good non-magnetic property but has a high L* value (i.e., has poor blackness) because of including a large amount of $TiO_2$.

The structure of the metal-containing material for use in the toner of the present invention can be identified by an X-ray diffractometer. Specifically, the measurements are performed under the following conditions:
(1) Measuring instrument: PINT1100 manufactured by Rigaku Corporation;
(2) Material of vessel: Cu;
(3) Voltage applied to vessel: 50 kv;
(4) Current in vessel: 30 mA; and
(5) Goniometer: wide-angle goniometer.

The specific surface area of the metal-containing material for use in the toner of the present invention is preferably from 1.3 to 80 $m^2/g$, and more preferably from 1.5 to 30 $m^2/g$, in view of dispersibility of the material in the toner. When the specific surface area of the metal-containing material is too large, the low temperature fixability cannot be imparted to the resultant toner depending on the addition quantity of the material. This is because the black metal-containing material serves as a filler like carbon blacks. In contrast, when the specific surface area is too small, high blackness cannot be imparted to the resultant toner.

In the present application, the specific surface area of metal-containing materials is measured using an automatic surface area measuring instrument, GEMINI 2360 from Shimadzu-Micromeritics. Namely, a method in which nitrogen gas is adsorbed on a sample and the surface area of the sample is measured utilizing a multipoint BET adsorption method is used.

The true specific gravity of the metal-containing material is preferably from 4.0 to 5.0 $g/cm^3$. By using such a metal-containing material for the toner of the present invention, the resultant toner has a true specific gravity in a proper range (i.e., the specific gravity of the toner becomes similar to that of a carrier), and thereby the toner can be efficiently mixed with a carrier when a developer is prepared.

In the present application, the true specific gravity is measured by an instrument, an air comparison pychnometer 930 manufactured by Beckman Japan.

The content of the metal-containing material in the toner of the present invention is preferably from 10 to 50 parts by weight, and more preferably from 15 to 25 parts by weight, per 100 parts by weight of the binder resin included in the toner. When the content is too low, good low temperature fixability and high blackness cannot be imparted to the toner. In contrast, when the content is too high, the metal-containing material is poorly dispersed in the toner, resulting in deterioration of charging properties of the toner, and thereby the developing ability of the toner deteriorates. In addition, the fixability of the toner also deteriorates.

The titanium-containing iron oxides for use in the toner of the present invention are typically prepared by the following method:
(1) a particulate magnetite which is coated with a titanium compound, a mixture of a magnetite powder and a titanium compound, or a particulate hematite which is coated with a titanium compound is reduced to produce a reduced powder;
(2) the reduced powder is calcined at a temperature not lower than 700° C. under a non-oxidizing atmosphere; and
(3) the calcined powder is pulverized to prepare the titanium-containing iron oxide.

Among the source materials mentioned above, the magnetite material coated with a titanium compound is preferably used because the resultant titanium-containing iron oxide tends to have a small magnetization (i.e., the material has a good non-magnetic property).

The particle form of the source materials (such as magnetite and hematite) is not particularly limited, and any particle form such as granular, spherical and needle forms can be available. The particle diameter of the source materials is preferably from 0.03 to 1.5 μm.

The particle size of a metal-containing iron oxide (i.e., the product) largely depends on the particle size of the source material, and the smaller the particle size of the source material, the smaller the particle size of the resultant metal-containing iron oxide.

Suitable titanium compounds for use in preparing the titanium-containing iron oxides include hydrated titanium oxides, titanium hydroxides, and titanium oxides. When magnetite is used for preparing the titanium-containing iron oxides, water soluble titanium compounds are preferably used in combination therewith.

In order to prepare a non-oxidizing atmosphere, a nitrogen gas or the like gas can be preferably used. Under an oxidizing atmosphere, the targeted black iron oxide compounds cannot be prepared.

The calcining is preferably performed at a temperature not lower than 700° C. When the calcining temperature is too lower, the solid phase reaction of the iron oxide with the titanium compound cannot be well performed, and thereby the targeted black pigment cannot be produced.

The pulverization operation can be performed by a pulverizer such as ball mills, attritors, vibration mills, etc.

When the titanium-containing iron oxides are prepared by the method mentioned above, the source materials can be coated with a sinter preventing agent before calcination to avoid sintering of the materials. By preventing sintering of the source materials, good diseprsibility can be imparted to the resultant black pigments. Suitable sinter preventing agents for use in the present invention include compounds containing one or more elements selected from the group consisting of Al, Ti, Si, Zr and P. The content of such a sinter preventing agent is from 0.1 to 15.0 atomic % based on the total of Fe and Ti. When the content is too low, good sinter preventing effect cannot be produced. In contrast, when the content is too high, the resultant black iron oxides have a magnetic property because magnetite is included in the resultant black iron oxide.

In order to heighten the blackness of the black iron oxide, black dyes or pigments, and/or blue dyes or pigments can be added to the black iron oxides. Such dyes and pigments can be preferably fixed on the black iron oxides using a mixer such as MECHANOMILL (manufactured by Okada Seiko Co., Ltd.) and MECHANO FUSION SYSTEM (manufactured by Hosokawa Micron Corp.).

Specific examples of such black dyes and pigments include black iron oxide, aniline black, graphite, fullerene, etc. Specific examples of the blue dyes and pigments include cobalt blue, Alkali Blue, Victoria Blue lake, Phthalocyanine Blue, metal-free Phthalocyanine Blue, partially-chlorinated Phthalocyanine Blue, Fast Sky Blue, Indanthrene Blue BC, etc.

The binder resin of the toner of the present invention include a crystalline polyester resin and a non-crystalline resin. In the toner of the present invention, the crystalline polyester and the non-crystalline resin form a phase-separation structure in which the resins are separated without being mixed to the other. Therefore, the resultant toner can have both the advantage of the crystalline polyester in that the resin sharply melts and thereby good low temperature fixability can be imparted to the toner, and the advantage of the non-crystalline resin in that the resin can impart good elasticity to the resultant toner, and thereby the offset resistance of the toner can be improved. Namely, the resultant toner can have both good low temperature fixability and wide fixable temperature range. When the binder resin does not form such a phase separation structure, such an effect cannot be produced.

Whether or not a crystalline polyester and a non-crystalline resin form a phase separation structure in a toner can be determined by subjecting the toner to an X-ray diffraction analysis. When a crystalline polyester is present in a toner while forming a phase separation structure, the X-ray diffraction spectrum has at least one diffraction peak at a Bragg (2θ) angle of from 20° to 25°, which is specific to the crystalline polyester resin. When the crystalline polyester is mixed with the non-crystalline resin and thereby the phase separation structure is not formed, the diffraction peak is not observed.

Whether or not a toner has a phase separation structure can also be determined by observing the cross section of the toner with a transmission electron microscope (TEM). Since a colorant is selectively present in a non-crystalline resin (i.e., the colorant is not dispersed in the crystalline polyester) in the case where the toner has a phase separation structure, regions (i.e., the crystalline polyester regions) including no colorant particles are present in the toner like islands in a sea.

The content of the crystalline polyester in the toner is preferably not greater than 50% by weight, more preferably from 1 to 50% by weight, and even more preferably from 3 to 30% by weight, based on the total weight of the binder resin included in the toner, to impart good sharp melting property to the toner and to avoid deterioration of the offset resistance and the preservability of the toner. When the content is too low, good low temperature fixability cannot be imparted to the toner. In contrast, when the content is too high, the polyester resin is poorly dispersed in the toner, and thereby the colorant and the release agent (e.g., waxes) are poorly dispersed in the toner, resulting in formation of images with background fouling and uneven image density.

The melting point of the crystalline polyester influences on the lowest fixable temperature of the toner. Namely, the lower the melting point, the better, the lowest fixable temperature. However, when the melting point is too low, the preservability of the toner deteriorates. Therefore, the melting point is as low as possible as long as the polyester does not deteriorate the preservability of the toner. Specifically, the melting point is preferably from 80 to 130° C., to impart good sharp melting property and good low temperature fixability to the toner. In this regard, the melting point of crystalline polyester resins is measured by a differential scanning calorimeter. Specifically, the melting point means the temperature at which the maximum endothermic peak is observed in the second temperature rising process (i.e., in the second heating process after one cycle of heating and cooling is completed).

Suitable crystalline polyesters for use in the toner of the present invention include aliphatic polyesters which are obtained from an alcohol component such as diol compounds having 2 to 20 carbon atoms and their derivatives, and an acid component such as polycarboxylic acid compounds, e.g., aliphatic dicarboxylic acids, aromatic dicarboxylic acids, alicyclic dicarboxylic acids, and their derivatives.

Among these polyesters, aliphatic polyesters which can be obtained from an alcohol component including a linear alkylene glycol having from 2 to 6 carbon atoms such as ethylene glycol, 1,4-butane diol and 1,6-hexane diol or a derivative of linear alkylene glycols, and an acid component including an aliphatic dicarboxylic acid such as maleic acid, fumaric acid and succinic acid, or a derivative of aliphatic acids and which have the following formula (1) are preferably used:

$$[—O—CO—CR_1{=}CR_2—CO—O—(CH_2)_n—]_m \quad (1),$$

wherein n and m are independently a positive integer (i.e., a repeat number); and $R_1$ and $R_2$ independently represent a hydrocarbon group.

In order to control the crystallinity and softening point of the crystalline polyester, it can be possible to polycondensate the polyester by adding a polyhydric alcohol having three or more hydroxyl groups, such as glycerin and/or a polybasic carboxylic acid having three or more carboxyl groups, such as trimellitic anhydride.

Whether such polyesters have a crystallinity can be judged from the X-ray diffraction spectrum thereof. Specifically, the polyester resins have at least one diffraction peaks in each of Bragg (2θ) angle ranges of from 19° to 20°, from 21° to 22°, from 23° to 25°, and from 29° to 31°.

Suitable non-crystalline resins for use in the toner of the present invention include known non-crystalline resins such as styrene resins such as polystyrene, poly-α-methylstyrene, polychlorostyrene, styrene/propylene copolymers, styrene/butadiene copolymers, styrene/vinyl chloride copolymers, styrene/vinyl acetate copolymers, styrene/maleic acid copolymers, styrene/acrylate copolymers, styrene/methacrylate copolymers, and styrene/acrylonitrile/acrylate copolymers; polyester resins, vinyl acetate resins, rosin-modified maleic acid resins, phenolic resins, epoxy resins, polyethylene resins, polypropylene resins, ionomer resins, polyurethane resins, silicone resins, ketone resins, xylene resins, petroleum resins, and hydrogenated petroleum resins.

Among these resins, styrene resins and polyester resins including an aromatic repeat unit are preferably used. In particular, polyester resins including an aromatic repeat unit are preferably used.

Non-crystalline polyester resins can be synthesized by a polyhydricalcohol and a polybasic carboxylic acid. Specific examples of the polyhydric alcohols and polybasic carboxylic acids include the compounds mentioned above for use in the crystalline polyester resins. In addition, compounds such as adducts of bisphenol A with an alkylene oxide, isophthalic acid, terephthalic acid, their derivatives and mixtures thereof can also be used when synthesizing polyester resins.

The non-crystalline resins for use in the toner of the present invention preferably have a glass transition temperature (Tg) of from 40 to 70° C. and an $F_{1/2}$ temperature of from 120 to 160° C., to impart good hot offset resistance to the toner. When the glass transition temperature is too low, the high temperature preservability of the toner deteriorates, resulting in occurrence of a blocking problem in that the toner particles adhere to each other, resulting in formation of a blocked toner. In contrast, when the glass transition temperature is too high, the low temperature fixability of the toner deteriorates.

When the $F_{1/2}$ temperature of the non-crystalline resin is too low, the hot offset resistance of the toner deteriorates. In contrast, when the $F_{1/2}$ temperature is too high, the resin has too large an elastic property, and thereby high shear stress has to be applied the toner constituents to disperse the toner constituents in the kneading process.

The $F_{1/2}$ temperature can be measured with a flow tester CF-500 manufactured by Shimadzu Corp. The measuring conditions are as follows:

(1) diameter of die: 1 mm;

(2) pressure of die: 10 kgf/cm$^2$; and (3) temperature rising speed: 3° C./min.

The $F_{1/2}$ temperature is defined as a temperature at which the die drops to a midpoint between the flow starting point at which the sample starts to flow and the flow finishing point at which all of the sample flows out (i.e., a temperature at which 50% of the resin sample flows out).

In the present application, the glass transition temperature of the non-crystalline resins is measured by a differential scanning calorimeter. Specifically, the glass transition temperature is determined from a curve in the second temperature rising process (i.e., in the second heating process after one cycle of heating and cooling is completed) using a tangent line method. Namely, the glass transition temperature is defined as the contact point between the tangent line of the endothermic curve at the temperatures near the glass transition temperature and the base line of the DSC curve.

The toner of the present invention includes a release agent. The melting point of the release agent is preferably from 70 to 90° C. When the melting point is too low, the high temperature preservability of the toner deteriorates. In contrast, when the melting point is too high, the resultant toner has poor releasing property at a relatively low fixing temperature, i.e., problems occur in that a cold offset problem occurs and a receiving paper is wound around the fixing roller. The melting point of release agents is measured by a differential scanning calorimeter. Specifically, the melting point means the temperature at which the endothermic peak is observed in the second temperature rising process (i.e., in the second heating process after one cycle of heating and cooling is completed).

Suitable waxes for use as the release agent include low molecular weight polyolefin waxes such as low molecular weight polyethylene and low molecular weight polypropylene; synthesized waxes such as Fisher-Tropsch waxes; natural waxes such as bead waxes, carnauba waxes, candelilla waxes, rice waxes, and montan waxes; petroleum waxes such as paraffin waxes and microcrystalline waxes; higher fatty acids such as stearic acid, palmitic acid and myristic acid; metal salts of higher fatty acids; higher fatty acid amides; and modified versions of these waxes. These waxes can be used alone or in combiantin.

The content of the release agent in the toner is preferably from 1 to 20 parts by weight, and more preferably from 3 to 10 parts by weight, per 100 parts by weight of the binder resin included in the toner.

In the present application, the glass transition temperature (Tg) and the melting point are measured by a thermal analyzer DSC-60 manufactured by Shimadzu Corp. The measuring conditions are as follows:

(1) temperature range: from 20 to 150° C.;

(2) temperature rising speed: 10° C./min; and (4) the glass transition temperature and melting point are determined from the curve in the second heating process after one cycle of heating at a heating speed of 10° C./min, and a cooling speed of 10° C./min is completed.

The black-colored metal-containing materials serve as a colorant in the toner of the present invention. The metal-containing materials can include a compound including one or more elements such as Pb, Sn, Al, Sb, Na, Mg, P, S, K, Ca, Cr, Co, Se, Be, Bi, Cd, Ni, W, V, Zn, Cl and C. In addition, known black colorants such as carbon black, oil furnace black, channel black, lamp black, acetylene black, azine dyes such as Aniline Black, and metal-containing azo dyes can be used in combination with the black-colored metal-containing material. Known blue colorants such as copper phthalocyanine blue can also be used in combination with the black-colored metal-containing as a complementary colorant.

The toner of the present invention can include a charge controlling agent if desired. Suitable charge controlling agents include known charge controlling agents such as Nigrosine dyes, triphenylmethane dyes, chromium-containing metal-complex dyes, molybdic acid-based chelate pigments, Rhodamine dyes, alkoxyamines, quaternary ammonium salts (including fluorine-containing quaternary ammonium salts), alkylamides, phosphorus and phosphorus-containing compounds, tungsten and tungsten-containing compounds, fluorine-containing activators, metal salts of salicylic acid, and metal salts of salicylic acid derivatives. Among these compounds, metal salts of salicylic acid, and metal salts of salicylic acid derivatives are preferably used. Suitable metals for use in the metal salts of salicylic acid and salicylic acid derivatives include Al, Zn, Ti, Sr, B, Si, Ni, Fe, Cr, Zr, etc.

The content of the charge controlling agent in the toner is typically from 0.1 to 10 parts by weight, and preferably from 1 to 5 parts by weight, per 100 parts by weight of the binder resin included in the toner, although the content is changed depending on the species of the binder resin used; whether or not an additive is added to the toner; and the manufacturing method of the toner (including the dispersion method).

The particle diameter of the toner of the present invention is not particularly limited, but is preferably from 2.5 to 10 μm in volume average particle diameter, to produce high quality images with good fine line reproducibility. The toner of the present invention has a relatively high true specific gravity compared to conventional toners including carbon black as a colorant. Therefore, pulverized particles can be easily collected in the pulverization process and the classification process, i.e., the toner has good pulverization efficiency. Accordingly, a toner having a small particle diameter can be easily prepared.

When a toner has a small particle diameter, the toner itself has high adhesive force, and thereby the toner tends to contaminate charge imparting members such as carriers, resulting in deterioration of the charging ability of the charge imparting members (i.e., decrease of charge quantity of the toner). Therefore, problems such as background fouling and toner scattering tend to be caused. However, the toner of the present invention hardly decreases the charge quantity even when the particle diameter is small, which is different from toners including carbon black as a colorant. Therefore the toner of the present invention is preferably used as a toner having a small particle diameter.

In the present application, the particle diameter (volume average particle diameter) can be measured by an instrument, TAII manufactured by Coulter Electronics, Inc.

The toner of the present invention can be typically prepared by pulverization methods which include a kneading process of kneading toner constituents upon application of heat thereto and a pulverization process, but are not limited thereto. For example, the toner of the present invention can also be prepared by polymerization methods and other methods. Specific examples of the polymerization methods include suspension polymerization methods, emulsion polymerization methods, dispersion polymerization methods, etc. Specific examples of the other methods include solution suspension methods, polymer suspension methods, methods utilizing elongation reaction and the like methods.

The toner of the present invention can include a fluidity improver, if desired. Suitable fluidity improvers include known fluidity improvers such as hydrophobized silica, titanium oxide, silicon carbide, aluminum oxide and barium titanate. These materials can be used alone or in combination. Among these materials, hydrophobized silica and titanium oxide are preferable because the materials can impart good fluidity and charging stability to the toner and the resultant toner can produce high quality images. In particular, by using a combination of hydrophobized silica and titanium oxide, a toner having good fluidity and charging property can be provided. The content of the fluidity improver in the toner is from 0.1 to 5 parts by weight, and preferably from 0.5 to 2 parts by weight, per 100 parts by weight of the toner.

The toner of the present invention can be used as a one component developer and for a two component developer when combined with a carrier.

In both the cases where the toner is used as a one component developer or for a two component developer, the toner is contained in a container and the toner container is typically distributed separately from the image forming apparatus for which the developer is used. Users set the toner container in the image forming apparatus.

The type of the container is not particularly limited, and known toner containers such as bottle type toner containers and cartridge type toner containers can be used.

The image forming apparatus for which the toner of the present invention is used is not particularly limited. Any known image forming apparatus utilizing electrophotography such as electrophotographic copiers and printers can be used.

The toner of the present invention is preferably used for fixing units in which a support having an image of the toner thereon is passed through a nip between two rollers to fix the toner image on the support upon application of heat thereto. In particular, when the toner is used for a fixing unit in which a non-elastic roller is used as the roller which contacts the image bearing surface of the support, the toner image can be fixed at a relatively low temperature (i.e., the toner image can be fixed in a relatively wide temperature range) compared to the case where conventional toners are used.

It is preferable for the toner of the present invention to be used for a roller fixing device in which the pressure applied to the two rollers is relatively low compared to that of conventional fixing devices. Since the pressure can be reduced, the thickness of the roller can also be reduced (i.e., the heat capacity of the fixing members can be reduced), and thereby the warm-up time of the fixing device can be decreased, resulting in energy saving.

In particular, it is preferable that the toner of the present invention is used for a fixing device which fixes a toner image on a support by passing the support with the toner image through the nip between two rollers, wherein the thickness of one of the rollers which contacts the toner image bearing surface of the support is not greater than 1.0 mm and the pressure (i.e., load/contact area of the two rollers) applied to the two rollers is not greater than $1\times10^5$ Pa.

By using the toner of the present invention, which has a sharp melting property and a high heat conductivity, for such a fixing device having fixing members with low heat capacity, the toner images can be fixed with little heat loss, i.e., the toner images can be fixed with good heat efficiency.

Then the fixing device for use in the fixing method of the present invention will be explained. FIG. 1 is an embodiment of the fixing device for use in the fixing method of the present invention, which has two heat rollers therein. A fixing roller 1 is a roller in which an offset preventing layer 4 is formed on a metal cylinder 3. The metal cylinder 3 is made of a metal having a high heat conductivity, such as aluminum, iron, stainless steel or brass. The offset preventing layer 4 is made of a material such as room temperature vulcanization rubbers (RTV), silicone rubbers, tetrafluoroethylene/perfluoroalkylvinyl ether (PFA) copolymers and polytetrafluoroethylene (PTFE). A heater 5 is arranged in the fixing roller 1.

Numeral 2 denotes a pressure roller having a metal cylinder 6 and an offset preventing layer 7 formed thereon. The metal cylinder 6 is typically made of the same metal as that used for the metal cylinder 3 of the fixing roller 1. The offset preventing layer 7 is also made of a material such as PFA and PTFE. The pressure roller 2 optionally has a heater 8 therein. The fixing roller 1 and the pressure roller 2 are rotated while being pressed to each other with springs provided on both ends thereof. A support S with an unfixed toner image T thereon is passed through the nip between the two rollers 1 and 2 to fix the toner image T on the support S.

In the fixing device, the thickness of the fixing roller 1 is not greater than 1.0 mm, and therefore the fixing roller 1 has a good temperature rising property. Namely, the fixing roller can be heated to a desired fixing temperature in a very short time. The thickness is preferably from 0.2 to 0.7 mm, although the thickness is determined depending on the strength and heat conductivity of the materials used for the metal cylinder 3 and the offset preventing layer 4.

The higher the pressure applied to the rollers, the better the fixing property of the fixed image. However, when a high pressure is applied to the fixing roller having a thickness not greater than 1 mm, the fixing roller cannot endure the pressure and is deformed. Therefore, the load applied to the rollers is not greater than $1.5\times10^5$ Pa, and preferably from $0.5\times10^5$ to $1.0\times10^5$ Pa. The pressure is calculated by the following equation (1):

$$P=L/A \quad (1)$$

wherein P represents the pressure; L represents the load applied by the springs provided on the both ends of the two rollers; and A represents the contact area of the two rollers.

The contact area of the two rollers can be determined by the following method:

(1) a sheet such as overhead projection sheets (OHP), which can change its surface condition upon application of heat thereto, is passed through the nip of the rollers;

(2) the sheet is suddenly stopped so as to be sandwiched by the two rollers;

(3) the sheet is discharged after 10-second stoppage at the nip; and (4) the area of the region of the sheet which changes its surface condition is measured to determine the contact area.

Figure 2:
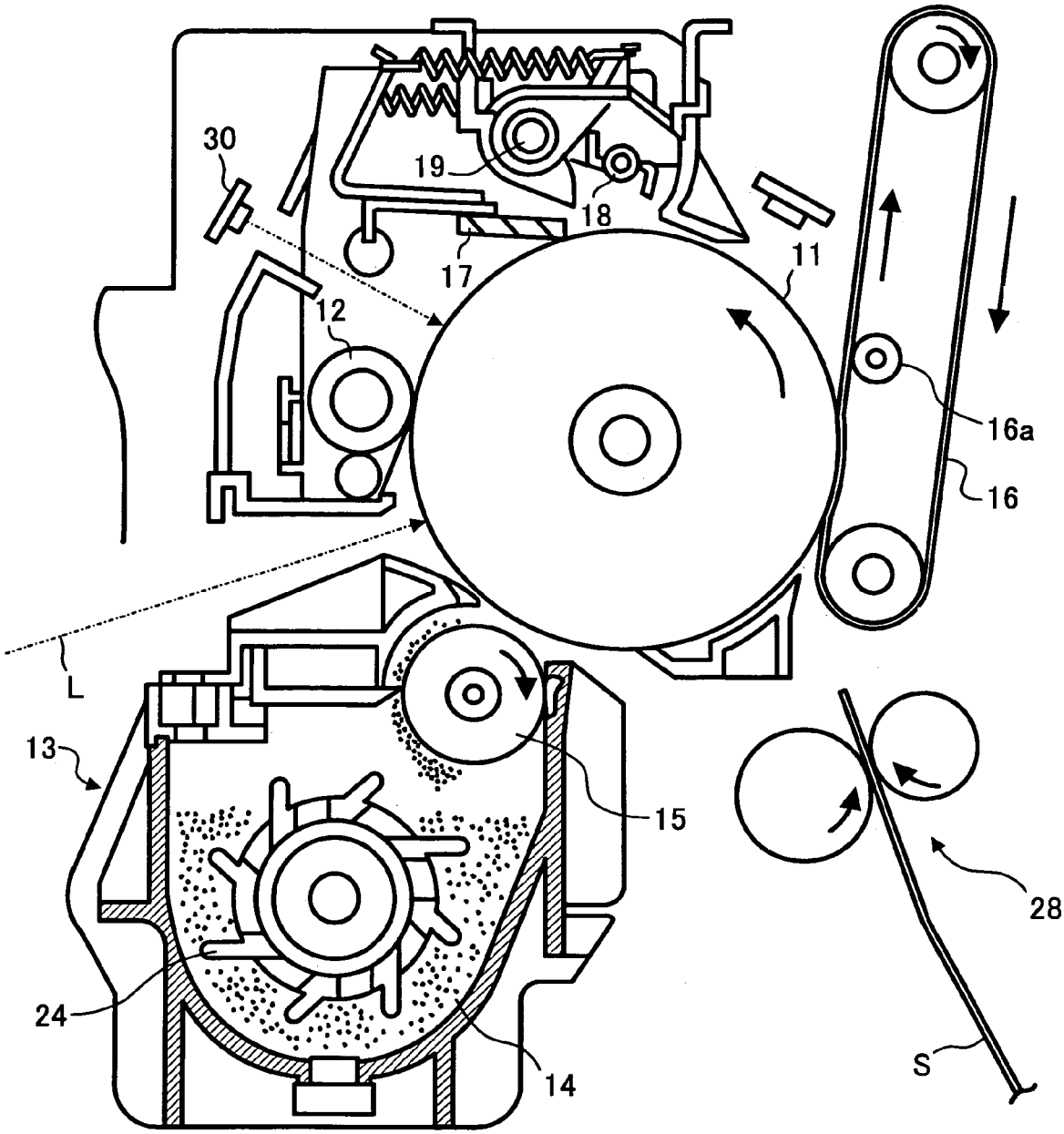
FIG. 2 is a schematic view illustrating an image forming apparatus for use in the image forming method of the present invention.

Next, the image forming apparatus for use in the image forming method of the present invention will be explained. FIG. 2 is a schematic view illustrating an image forming apparatus for use in the image forming method of the present invention.

Referring to FIG. 2, a photoreceptor 11 serving as an image bearing member is rotated in a direction (i.e., counterclockwise) indicated by an arrow and uniformly charged with a charging roller 12. Then imagewise light L of an original, which is sent from a scanner (not shown) of a copier, or laser light L emitted from a writing device (not shown) of a printer irradiates the charged photoreceptor 11 to form an electrostatic latent image on the photoreceptor 11.

A developer 14 which is a two component developer which is a mixture of the toner of the present invention and a carrier is contained in a developing device 13. The developer 14 is agitated by a paddle 24 to frictionally charge the toner. A developing sleeve 15 in which a magnet roller having plural magnets or plural magnetic poles is arranged so as to face the photoreceptor 11. The developer 14 is borne on the developing sleeve 15 by a magnetic force of the magnet roller and fed to the position facing the photoreceptor 11 to develop the electrostatic latent image with the toner in the developer 14.

A transfer belt 16 is provided on a downstream side from the developing device 13 relative to the rotation direction of the photoreceptor 11. The transfer belt 16 is tightly stretched and rotated in a direction indicated by an arrow by a driving roller and a driven roller. In addition, the transfer belt 16 is attached to or detached from the photoreceptor 11 by a attaching/detaching mechanism (not shown). The transfer belt 16 is attached to the photoreceptor 11 to form a nip, through which a receiving sheet S is fed so that the toner image on the photoreceptor 11 is transferred on the receiving sheet S. A bias voltage (transfer bias) which has a polarity opposite to that of the toner is applied to the backside of the transfer belt 16 via a bias roller 16*a*.

The receiving sheet S which is fed from a paper feeding section (not shown) is fed to the nip between the photoreceptor 11 and the transfer belt 16 by a pair of registration roller 28 such that the toner image on the photoreceptor 11 is transferred to a proper position of the receiving sheet S. Then the toner image on the photoreceptor 11 is transferred on the receiving sheet S, which is sandwiched by the photoreceptor 11 and the transfer belt 16, due to the electric field formed between the photoreceptor 11 and the transfer belt 16. The receiving sheet S having the toner image thereon is fed to a fixing device (not shown) by the transfer belt 16 to fix the toner image on the receiving sheet S upon application of heat thereto. The fixing device has a constitution as illustrated in FIG. 1. The receiving sheet S on which the toner image is fixed is discharged to a discharge section.

Toner particles remaining on the photoreceptor 11 even after the image transfer operation is scraped off by a cleaning blade 17. The residual toner is collected and contained in a collection coil 19 by a collection spring 18. The thus collected toner is returned to the developing device 13. Thus, the residual toner is recycled. In addition, the charge remaining on the photoreceptor 11 after the image transfer operation is discharged by a discharge lamp 30.

The toner of the present invention can be used in a process cartridge which is detachably set in an image forming apparatus such as copiers and printers.

The process cartridge of the present invention means an image forming unit which includes at least an image bearing member such as photoreceptors and a developing device containing the developer of the present invention (i.e., a developer including the toner of the present invention).

Figure 3:
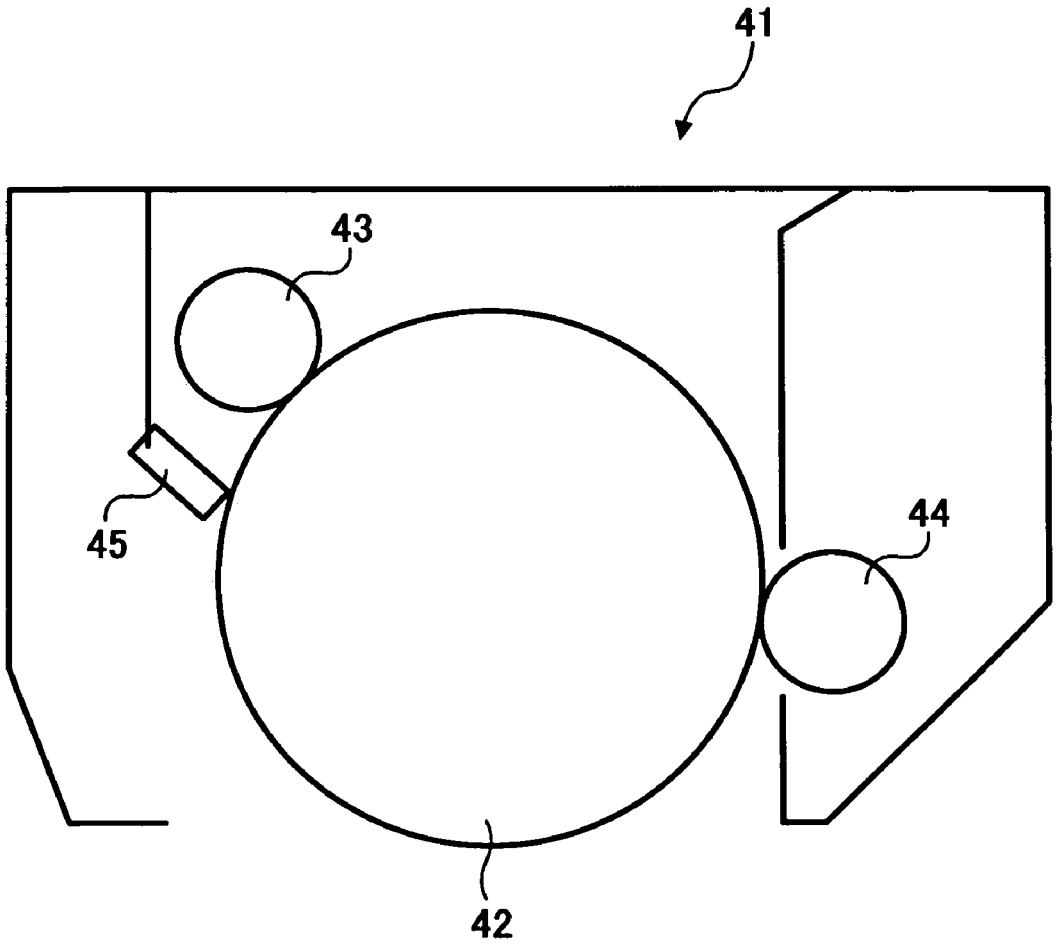
FIG. 3 is a schematic view illustrating the cross section of an embodiment of the process cartridge of the present invention.

FIG. 3 is a schematic view illustrating the cross section of an embodiment of the process cartridge of the present invention. Numeral 41 denotes a process cartridge. The process cartridge 41 includes a photoreceptor 42 serving as an image bearing member bearing an electrostatic latent image thereon, a charger 43 which charges the photoreceptor 42, a developing roller 44 serving as a member of a developing device which develops the electrostatic latent image on the photoreceptor 42 with the developer of the present invention to form a toner image on the photoreceptor 42, and a cleaning blade 45 which serves as a cleaner and which removes toner particles remaining on the surface of the photoreceptor 42 after the toner image on the photoreceptor 42 is transferred onto a receiving material (not shown).

The process cartridge is not limited to the process cartridge 41 illustrated in FIG. 3. Any process cartridges including at least an image bearing member and a developing device including the toner of the present invention can be used as the process cartridge of the present invention.

The process cartridge of the present invention is detachably set in an image forming apparatus. In the image forming apparatus in which the process cartridge is set, the photoreceptor 42 is rotated at a predetermined rotation speed. The photoreceptor 42 is charged with the charger 23 and thereby the photoreceptor 42 is uniformly charged positively or negatively. Then an image irradiating device (not shown) irradiates the charged surface of the photoreceptor 42 with light using a method such as slit irradiation methods and laser beam irradiation methods, resulting in formation of electrostatic latent image on the photoreceptor 42.

The thus prepared electrostatic latent image is developed by the developing roller 44 bearing the developer of the present invention thereon, resulting in formation of a toner image on the photoreceptor 42. The toner image is then transferred onto a receiving material (not shown) which is timely fed by a feeding device (not shown) to a transfer position between the photoreceptor 42 and a transfer device (not shown).

The toner image formed on the receiving material is then separated from the photoreceptor 42 and fixed by a heat/pressure fixing device (not shown) including a fixing roller. The fixed image is discharged from the image forming apparatus. Thus, a hard copy is produced.

The surface of the photoreceptor 42 is cleaned by the cleaning blade 45 to remove toner remaining on the photoreceptor 42, followed by discharging, to be ready for the next image forming operation.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following components were mixed and agitated using a HENSCEL MIXER.

| | |
|---|---|
| Crystalline polyester resin No. 1 (its composition and properties are shown in Table 1) | 70 parts |
| Non-crystalline resin No. 5 (its composition and properties are shown in Table 2) | 30 parts |
| Metal-containing material No. 1 (its composition and properties are shown in Table 3) | 20 parts |
| Carbon black | 1 part |
| Polyethylene wax (melting point of 120° C.) | 5 parts |
| Zinc salicylate | 2 parts |

The mixture was kneaded with a two-axis extruder, followed by cooling. The kneading operation was performed while the temperature of the kneaded mixture discharged from the exit of the extruder was controlled to be about 120° C. Then the kneaded mixture was pulverized and classified to prepare a mother toner having a volume average particle diameter of 11±0.5 μm.

Then 100 parts of the mother toner were mixed with 0.5 parts of a hydrophobized silica and 0.3 parts of titanium oxide.

Thus, a toner of Example 1 was prepared.

The toner was evaluated by the evaluation methods mentioned below. The fixing device No. 1 was used to evaluate the fixing property of this toner. The results are shown in Table 4 below.

Example 2

The procedure for preparation and evaluation of the toner in Example 1 was repeated except that the fixing device No. 2 (a low temperature fixing device) was used for evaluating the fixing property.

The results are shown in Table 4.

Comparative Example 1

The procedure for preparation and evaluation of the toner in Example 1 was repeated except that the metal-containing material was not added and the addition amount of the carbon black was changed from 1 part to 10 parts.

The results are shown in Table 4.

Comparative Example 2

The procedure for preparation and evaluation of the toner in Comparative Example 1 was repeated except that the fixing device No. 2 (a low temperature fixing device) was used for evaluating the fixing property of the toner.

The results are shown in Table 4. The low temperature fixability of this toner is inferior to that of the toner of Example 2.

Example 3

The procedure for preparation and evaluation of the toner in Example 1 was repeated except that the pulverization and classification operations were changed such that the resultant mother toner has a volume average particle diameter of from 6.5±0.5 μm, and the addition amounts of the hydrophobized silica and titanium oxide were changed to 0.8 parts and 0.4 parts, respectively.

The results are also shown in Table 4. This toner has a relatively good fine line reproducibility compared to that of the toner of Example 1. In addition, although the toner has a small particle diameter, the toner did not cause the background fouling problem in that background of the resultant images is soiled with the toner or the toner scattering problem in that the toner is scattered in the developing device and contaminates image forming members.

Example 4

The procedure for preparation and evaluation of the toner in Example 3 was repeated except the formula of the toner was changed as follows.

| | |
|---|---|
| Crystalline polyester resin No. 2 (its composition and properties are shown in Table 1) | 30 parts |
| Non-crystalline resin No. 5 (its composition and properties are shown in Table 2) | 70 parts |
| Metal-containing material No. 2 (its composition and properties are shown in Table 3) | 20 parts |
| Carbon black | 1 part |
| Polyethylene wax (melting point of 90° C.) | 5 parts |
| Zinc salicylate | 2 parts |

The results are shown in Table 4. Since the melting point of the crystalline polyester resin is lower than that of the crystalline polyester resin used in Example 1, this toner has a relatively good low temperature fixability compared to that of the toner of Example 1. Since the melting point of the wax is 90° C., i.e., relatively low compared to that of the wax used in Example 1, the low temperature fixability of this toner is excellent.

Example 5

The procedure for preparation and evaluation of the toner in Example 3 was repeated except that the formula of the toner was changed as follows.

| | |
|---|---|
| Crystalline polyester resin No. 2 (its composition and properties are shown in Table 1) | 20 parts |
| Non-crystalline resin No. 6 (its composition and properties are shown in Table 2) | 80 parts |
| Metal-containing material No. 2 (its composition and properties are shown in Table 3) | 25 parts |
| Carnauba wax (melting point of 83° C.) | 5 parts |
| Zinc salicylate | 2 parts |

The results are shown in Table 4. Carbon black is not included in the toner in view of safety, but the resutant toner has good blackness. In addition, the addition amount of the metal-containing material is relatively large, but the resultant toner image has high image density without causing the background fouling problem and the toner scattering problem.

Example 6

The procedure for preparation and evaluation of the toner in Example 5 was repeated except that the metal-containing material No. 2 was replaced with 20 parts of a metal-containing material No. 3.

The results are shown in Table 4. The low temperature fixability of this toner is inferior to that of the toner of Example 5. Therefore, it is confirmed that the surface area of the metal-containing material is preferably not greater than that of the metal-containing material No. 3.

Example 7

The procedure for preparation and evaluation of the toner in Example 3 was repeated except that the formula of the toner was changed to the following:

| | |
|---|---|
| Crystalline polyester resin No. 3 (its composition and properties are shown in Table 1) | 15 parts |
| Non-crystalline resin No. 6 (its composition and properties are shown in Table 2) | 85 parts |
| Metal-containing material No. 4 (its composition and properties are shown in Table 3) | 20 parts |
| Carnauba wax (melting point of 83° C.) | 5 parts |
| Ferric salicylate | 1 part |

The results are shown in Table 4. This toner does not include carbon black and any PRTR material.

Example 8

The procedure for preparation and evaluation of the toner in Example 3 was repeated except that the formula of the toner was changed to the following:

| | |
|---|---|
| Crystalline polyester resin No. 4 (its composition and properties are shown in Table 1) | 20 parts |
| Non-crystalline resin No. 7 (its composition and properties are shown in Table 2) | 80 parts |
| Metal-containing material No. 5 (its composition and properties are shown in Table 3) | 20 parts |
| Carnauba wax (melting point of 83° C.) | 5 parts |
| Ferric salicylate | 1 part |

The results are shown in Table 4. Although the melting point of the crystalline polyester resin No. 4 is lower than that of the crystalline polyester No. 1, the low temperature fixability of this toner is inferior to that of the toner of Example 3. The reason therefor is considered to be as follows. The content of titanium in the metal-containing material is relatively high and the true specific gravity thereof is relatively low compared to those of the metal-containing material No. 1 and therefore the content of titanium oxide in the material is considered to be high. Therefore, the effect of the metal-containing material is hardly produced. Since the content of titanium oxide is high, the image density of the resultant images is low.

As a result, the content of titanium in the metal-containing material is preferably not greater than the content (i.e., 46% by weight) of the metal-containing material No. 5. In addition, the preservability of this toner is not on an excellent level. Therefore, it is confirmed that the melting point of the crystalline polyester resin is preferably not lower than that (i.e., 79° C.) of the crystalline polyester No. 4.

Example 9

The procedure for preparation and evaluation of the toner in Example 8 was repeated except that the metal-containing material No. 5 was replaced with 20 parts of a metal-containing material No. 6 and 0.8 parts of a copper phthalocyanine blue pigment serving as a complementary colorant were added.

In this case, the a* and b* values of the metal-containing material No. 6 are 1.3 and 0.8, respectively, and the resultant toner had a reddish black color. Therefore it is necessary to add the copper phthalocyanine pigment to prepare a black toner. Namely, it is confirmed that the a* and b* values of the metal-containing material is preferably from −1.0 to +1.0, respectively because it is not necessary to add a complementary colorant.

Example 10

The procedure for preparation and evaluation of the toner in Example 3 was repeated except that the formula of the toner was changed to the following:

| | |
|---|---|
| Crystalline polyester resin No. 3 (its composition and properties are shown in Table 1) | 20 parts |
| Non-crystalline resin No. 6 (its composition and properties are shown in Table 2) | 80 parts |
| Metal-containing material No. 1 (its composition and properties are shown in Table 3) | 50 parts |
| Carnauba wax (melting point of 83° C.) | 5 parts |
| Ferric salicylate | 1 part |

The results are shown in Table 4. In this case, the content of the metal-containing material is relatively high (i.e., 50%), and therefore, the low temperature fixability is not so good but is still acceptable. Therefore, it is confirmed that the content of the metal-containing material is preferably not greater than 50%.

Comparative Example 3

The procedure for preparation and evaluation of the toner in Example 10 was repeated except that the metal-containing material No. 1 was replaced with 25 parts of the metal-containing material No. 7 (its composition and properties are shown in Table 3).

The results are shown in Table 4. The resultant images have low image density because the amount of the toner adhered to the latent image is relatively small compared to that in the case of the toner of Example 10.

Example 11

The procedure for preparation and evaluation of the toner in Example 3 was repeated except that the formula of the toner was changed to the following:

| | |
|---|---|
| Crystalline polyester resin No. 2 (its composition and properties are shown in Table 1) | 50 parts |
| Non-crystalline resin No. 7 (its composition and properties are shown in Table 2) | 50 parts |
| Metal-containing material No. 3 (its composition and properties are shown in Table 3) | 15 parts |
| Carbon black | 3 parts |
| Carnauba wax (melting point of 83° C.) | 5 parts |
| Ferric salicylate | 1 part |

The results are shown in Table 4. In this case, the image qualities such as hot offset resistance, image density and background fouling and the preservability of the toner are on acceptable levels. Therefore, it is confirmed that the amount of the crystalline polyester resin in the toner of the present invention is preferably not greater than the content (50%) in this toner.

Example 12

The procedure for preparation and evaluation of the toner in Example 3 was repeated except that the formula of the toner was changed to the following:

| | |
|---|---|
| Crystalline polyester resin No. 3 (its composition and properties are shown in Table 1) | 20 parts |
| Non-crystalline resin No. 8 (its composition and properties are shown in Table 2) | 80 parts |
| Metal-containing material No. 4 (its composition and properties are shown in Table 3) | 20 parts |
| Carnauba wax (melting point of 83° C.) | 5 parts |
| Ferric salicylate | 1 part |

The results are shown in Table 4. In this case, the glass transition temperature of the non-crystalline resin No. 4 is relatively high (71° C.), and therefore the low temperature fixability of this toner is not so good. Therefore, it is confirmed that the glass transition temperature of the non-crystalline resin is preferably not higher than that of the non-crystalline resin No. 4.

Comparative Example 4

The procedure for preparation and evaluation of the toner in Example 3 was repeated except that the formula of the toner was changed to the following:

| | |
|---|---|
| Crystalline polyester resin No. 6 (its composition and properties are shown in Table 1) | 55 parts |
| Non-crystalline resin No. 9 (its composition and properties are shown in Table 2) | 45 parts |
| Carbon black | 10 parts |
| Carnauba wax (melting point of 83° C.) | 5 parts |
| Ferric salicylate | 1 part |

The results are shown in Table 4. In this case, the low temperature fixability of this toner is worse than those of the toners of Examples 1 to 12 and is not acceptable.

Comparative Example 5

The procedure for preparation and evaluation of the toner in Example 3 was repeated except that the formula of the toner was changed to the following:

| | |
|---|---|
| Crystalline polyester resin No. 2 (its composition and properties are shown in Table 1) | 35 parts |
| Non-crystalline resin No. 7 (its composition and properties are shown in Table 2) | 65 parts |
| Carbon black | 12 parts |
| Carnauba wax (melting point of 83° C.) | 5 parts |
| Ferric salicylate | 1 part |

The results are shown in Table 4. In this case, the content of the carbon black is increased but the crystalline polyester resin does not disperse the colorant, and thereby the background fouling problem and the toner scattering problem were caused.

TABLE 1

| | Composition | | | |
|---|---|---|---|---|
| | Acid component | Alcohol component | Diffraction peak* | Melting point (° C.) |
| Polyester resin No. 1 | Fumaric acid, trimellitic anhydride | Ethylene-glycol, 1,6-hexanediol | Yes | 132 |
| Polyester resin No. 2 | Fumaric acid | 1,4-butanediol, 1,6-hexanediol | Yes | 100 |
| Polyester resin No. 3 | Fumaric acid, succinic acid | Ethylene-glycol, 1,6-hexanediol | Yes | 90 |
| Polyester resin No. 4 | Fumaric acid | Ethylene-glycol, 1,6-hexanediol | Yes | 79 |

X-ray Diffraction Peak*:

Yes: at least one peak is present in each of Bragg (2θ) angle ranges of from 19° to 20°, from 21° to 22°, from 23° to 25°, and from 29° to 31°.

TABLE 2

| | Composition | X-ray diffraction peak* | Tg (° C.) | F ½ Temp. (° C.) |
|---|---|---|---|---|
| Non-crystalline resin No. 5 | Styrene/methyl acrylate copolymer | No | 63 | 149 |
| Non-crystalline resin No. 6 | Polyester*2 | No | 60 | 148 |
| Non-crystalline resin No. 7 | Polyester*3 | No | 61 | 156 |

TABLE 2-continued

| | Composition | X-ray diffraction peak* | Tg (° C.) | F ½ Temp. (° C.) |
|---|---|---|---|---|
| Non-crystalline resin No. 8 | Polyester*4 | No | 71 | 158 |
| Non-crystalline resin No. 9 | Polyester*5 | No | 65 | 92 |

X-ray Diffraction Peak*:

No: there is no peak in the angle ranges mentioned above, or there is no peak in one or more ranges of the angle ranges mentioned above.

Composition of Polyester*2:

acid component: fumaric acid, terephthalic acid and trimellitic anhydride; and alcohol component: bisphenol A—poloxyethylene Composition of Polyester*3:

acid component: fumaric acid, terephthalic acid and trimellitic anhydride; and alcohol component: bisphenol A—poloxyethylene and bisphenol A—poloxypropylene Composition of Polyester*4:

acid component: terephthalic acid and maleic acid; and alcohol component: bisphenol A—poloxyethylene and bisphenol A—poloxypropylene Composition of Polyester*5:

acid component: terephthalic acid and fumaric acid; and alcohol component: bisphenol A—poloxyethylene and bisphenol A—poloxypropylene

TABLE 3

| | Metal | σs (emu/g) | L* | a* | b* | Ti content (wt %) | Surface area ($m^2/g$) | True specific gravity |
|---|---|---|---|---|---|---|---|---|
| Metal-containing material No. 1 | Fe, Mn, Al | 39.3 | 17.9 | 0.1 | −0.7 | 0 | 28 | 4.2 |
| Metal-containing material No. 2 | Fe, Mn, Cu, Ti | 1.8 | 18.4 | 0.0 | −0.3 | 12 | 15 | 4.4 |
| Metal-containing material No. 3 | Mn | 0.5 | 11.4 | 0.3 | 0.1 | 0 | 40 | 4.5 |
| Metal-containing material No. 4 | Fe, Ti | 12.5 | 9.7 | −0.1 | 0.3 | 25 | 19 | 4.5 |
| Metal-containing material No. 5 | Fe, Ti | 6.5 | 19.3 | 0.1 | −0.3 | 46 | 1.4 | 4.5 |
| Metal-containing material No. 6 | Fe, Ti | 8.4 | 12.8 | 1.3 | 0.8 | 16 | 12 | 45 |
| Metal-containing material No. 7 | Fe, Cu | 75 | 14.8 | 0.1 | 0.4 | 0 | 14 | 4.4 |

The toners of Examples 1 to 12 and Comparative Examples 1 to 5 were evaluated by the following methods.

1. Preservability (PA)

About 20 g of a toner is contained in a glass container, followed by tapping 50 times to densify the toner. Then the toner is allowed to settle for 24 hours in a chamber heated at 50° C. After the toner is cooled, the penetration of the toner is measured to determine the penetration degree. The penetration degree (PD) is defined as follows:

$$PD=(Pe/H)\times 100\ (\%)$$

wherein Pe represents the penetration in units of millimeter, and H represents the height of the toner in the glass container in units of millimeter.

The preservability (PA) of the toners is graded as follows.

⊚: 90%<(PD)≦100% (excellent)

○: 75%<(PD)≦90% (good)

□: 50%<(PD)≦75% (acceptable)

Δ: 25%<(PD)≦50% (poor)

X: (Pd)≦25% (very poor)

2. Fixing Property (FX)

Each of the toners are set in a copier, IMAGIO NEO 350 manufactured by Ricoh Co. Ltd. One of the following fixing devices in which the fixing temperature can be changed is used as the fixing device of the copier, and TYPE 6200 PAPER is used as the receiving paper.

Fixing Device No. 1

(1) fixing roller

Constitution: constitution illustrated in FIG. 1

Material of metal cylinder: SUS (stainless steel)

Thickness of metal cylinder: 3.0 mm

Material of offset preventing layer: PTFE

Thickness of offset preventing layer: 20 μm (2) pressure roller

Constitution: constitution illustrated in FIG. 1

Material of metal cylinder: SUS

Thickness of metal cylinder: 2.0 mm

Material of offset preventing layer: PFA/silicone rubber

Thickness of offset preventing layer: 50 μm/4 μm (3) pressure: $2.5\times10^5$ Pa (4) paper feeding speed: 180 mm/sec Fixing Device No. 2

(1) fixing roller

Constitution: constitution illustrated in FIG. 1

Material of metal cylinder: aluminum

Thickness of metal cylinder: 0.5 mm

Material of offset preventing layer: PTFE

Thickness of offset preventing layer: 16 μm (2) pressure roller

Constitution: constitution illustrated in FIG. 1

Material of metal cylinder: aluminum

Thickness of metal cylinder: 1.0 mm

Material of offset preventing layer: PFA/silicone rubber

Thickness of offset preventing layer: 30 μm/3 μm (3) pressure: $9\times10^4$ Pa (4) paper feeding speed: 180 mm/sec The toner images are fixed while the fixing temperature is changed, to determine the cold offset temperature (i.e., the low temperature fixability) and the hot offset temperature (i.e., the hot offset resistance) of the toner. This test is performed while the paper feeding speed is set to 50 mm, which is a severe condition for the offset.

The low temperature fixability (LTF) is graded as follows.

◎: (Cold offset temp.)<120° C. (excellent)

○: 120° C.≦(Cold offset temp.)<130° C. (good)

Δ: 130° C.≦(Cold offset temp.)<140° C. (acceptable)

X: 140° C.≦(Cold offset temp.)<150° C. (poor)

XX: 150° C.≦(Cold offset temp.) (very poor)

The hot offset resistance (HOT) is graded as follows.

◎: 210° C.≦(Hot offset temp.) (excellent)

○: 200° C.≦(Hot offset temp.)≦210° C. (good)

Δ: 190° C.≦(Cold offset temp.)<200° C. (acceptable)

X: 180° C.<(Cold offset temp.)≦190° C. (poor)

XX: (Cold offset temp.)<180° C. (very poor)

3. Image Density (ID)

Each of the toners is set in the copier, IMAGIO NEO 350, and a black solid image is produced. Image densities of randomly selected six points of the black solid image are measured with a Macbeth densitometer to obtain an average image density of the solid image. The image density (ID) is graded as follows.

◎: Average image density is very high (excellent)

○: Average image density is high (good)

□: Average image density is the same as those of conventional toners including carbon black (acceptable)

Δ: Average image density is low (poor)

X: Average image density is very low (very poor)

4. Background Fouling (GD)

Each of the toners is set in the copier, IMAGIO NEO 350, and a 1,000,000-copy running test is performed. Then a white solid image is produced. Image densities of randomly selected six points of the white solid image are measured with a Macbeth densitometer to obtain an average background density and to determine the difference ($D-D_0$) in density between the white solid image (D) and the receiving paper ($D_0$), which is not used for the copy test. The background fouling (GD) is graded as follows.

◎: excellent (the density difference ($D-D_0$) is very little.)

○: good

□: acceptable

Δ: bad

X: very bad (the density difference is very large.)

5. Toner Scattering (TS)

Each of the toners is set in the copier, IMAGIO NEO 350, and a 1,000,000-copy running test is performed. After the running test, the inside of the copier is observed to determine whether the toner is scattered. The toner scattering (TS) is graded as follows.

◎: excellent (the toner is hardly scattered.)

○: good

□: acceptable (the same level as those in the case where conventional toners including carbon black are used)

Δ: bad

X: very bad (the toner is seriously scattered.)

6. Fine Line Reproducibility (FLR)

A lattice image constituted of 1-dot vertical lines (600 dot/inch) and 1-dot horizontal lines (600 dot/inch) are printed at a density of 150 line/inch. The lattice image is observed to determine whether the lattice image includes cut lines and low density portions.

◎: excellent (the image hardly includes cut lines and low density portions.)

○: good

□: acceptable

Δ: bad

X: very bad (the image includes many cut lines and low density portions.)

The results are shown in Table 4.

TABLE 4

| | X-ray Peak* | Fixing device | LTF | HOT | PA | ID | GD | TS | FLR |
|---|---|---|---|---|---|---|---|---|---|
| Ex. 1 | Yes | No. 1 | □ | ○ | ○ | □ | ○ | ○ | □ |
| Ex. 2 | Yes | No. 2 | ○ | ○ | ○ | □ | ○ | ○ | □ |
| Comp. Ex. 1 | Yes | No. 1 | Δ | ○ | ○ | □ | □ | □ | □ |
| Comp. Ex. 2 | Yes | No. 2 | Δ | ○ | ○ | □ | □ | □ | □ |
| Ex. 3 | Yes | No. 2 | ○ | ○ | ○ | □ | ○ | ○ | ◎ |
| Ex. 4 | Yes | No. 2 | ◎ | ○ | ○ | □ | ○ | ○ | ◎ |
| Ex. 5 | Yes | No. 2 | ◎ | ◎ | ◎ | ○ | ◎ | ◎ | ◎ |
| Ex. 6 | Yes | No. 2 | □ | ◎ | ◎ | ◎ | ◎ | ◎ | ◎ |
| Ex. 7 | Yes | No. 2 | ◎ | ◎ | ◎ | ○ | ◎ | ◎ | ◎ |
| Ex. 8 | Yes | No. 2 | ○ | ○ | □ | □ | ◎ | ○ | ◎ |
| Ex. 9 | Yes | No. 2 | ◎ | ○ | □ | ◎ | ◎ | ◎ | ◎ |
| Ex. 10 | Yes | No. 2 | □ | ◎ | ◎ | ○ | ○ | ○ | ○ |
| Comp. Ex. 3 | Yes | No. 2 | ◎ | ◎ | ◎ | X | ○ | ○ | X |
| Ex. 11 | Yes | No. 2 | ◎ | □ | □ | □ | □ | ○ | ○ |
| Ex. 12 | Yes | No. 2 | □ | ◎ | ◎ | ◎ | ◎ | ◎ | ◎ |
| Comp. Ex. 4 | No | No. 2 | Δ | ◎ | ◎ | □ | ○ | ○ | ◎ |
| Comp. Ex. 5 | Yes | No. 2 | ○ | ○ | ◎ | □ | X | Δ | ○ |

X-ray peak*:

Yes: At least one peak is present in a Bragg (2θ) angle range of from 20° to 25°.

No: There is no peak in a Bragg (2θ) angle range of from 20° to 25°.

As can be understood from Table 4, the toner of the present invention has good low temperature fixability, offset resistance and preservability without causing background fouling and toner scattering. In particular, the toners of Examples 5 and 7 have excellent properties.

This document claims priority and contains subject matter related to Japanese Patent Application No. 2003-032687, filed on Feb. 10, 2003, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by letters Patent of the United States is:

1. A toner comprising:

a binder resin comprising a crystalline polyester and a non-crystalline resin;

a release agent; and a black metal-containing material having a saturation magnetization not greater than 50 emu/g;

wherein the black metal-containing material is a titanium-containing iron oxide.

2. The toner according to claim 1, wherein the black metal-containing material has a color such that L*, a* and b* values of the color is not greater than 15, from−1.0 to 1.0 and from−1.0 to 1.0, respectively.

3. The toner according to claim 1, wherein the titanium-containing iron oxide includes titanium in an amount of from 10 to 45% by weight based on iron atom included in the titanium-containing iron oxide.

4. The toner according to claim 1, wherein the black metal-containing material has a specific surface area of from 1.5 to 30 $m^2/g$.

5. The toner according to claim 1, wherein the black metal-containing material has a true specific gravity of from 4.0 to 5.0.

6. The toner according to claim 1, wherein the black metal-containing material is included in the toner in an amount of from 10 to 50 parts by weight per 100 parts by weight of the binder resin.

7. The toner according to claim 1, wherein the toner has an X-ray diffraction spectrum such that at least one diffraction peak is observed at a Bragg (2θ) angle of from 20° to 25°.

8. The toner according to claim 1, wherein the non-crystalline resin comprises a polyester resin.

9. The toner according to claim 1, wherein the crystalline polyester is included in an amount not greater than 50% by weight based on the total weight.

10. The toner according to claim 1, wherein the crystalline polyester has a melting point of from 80 to 130° C.

11. The toner according to claim 1, wherein the crystalline polyester has an X-ray diffraction spectrum such that at least one diffraction peak is observed in each of Bragg (2θ) angle ranges of from 19° to 20°, from 21° to 22°, from 23° to 25° and from 29° to 31°.

12. The toner according to claim 1, wherein the crystalline polyester has the following formula (1):

$$[—C—CO—CR_1=CR_2—CO—O—(CH_2)_n—]_m \quad (1)$$

wherein n and m independently represents an integer; and $R_1$ and $R_2$ independently represent a hydrocarbon group.

13. The toner according to claim 1, wherein the non-crystalline resin has a glass transition temperature of from 40 to 70° C., and an F½ temperature of from 120 to 160° C.

14. The toner according to claim 1, wherein the release agent has a melting point of from 70 to 90° C.

15. The toner according to claim 1, wherein the toner has a volume average particle diameter of from 2.5 to 10 μm.

16. A toner container containing the toner according to claim 1.

17. A method for fixing an image of the toner according to claim 1, comprising:

passing a support with the toner image thereon through a nip between two cylindrical rollers while applying a pressure not greater than $1\times10^5$ Pa to the two cylindrical rollers, wherein one of the cylindrical rollers which contacts the toner image has a thickness not greater than 1.0 mm.

18. An developing method comprising:

developing an electrostatic latent image on an image bearing member with the toner according to claim 1 to form a toner image on the image bearing member.

19. An image forming method comprising:

developing an electrostatic latent image on an image bearing member with the toner according to claim 1 to form a toner image on the image bearing member;

transferring the toner image onto a receiving material optionally via an intermediate transfer member; and fixing the toner image on the receiving material by passing a support with the toner image thereon through a nip between two cylindrical rollers while applying a pressure not greater than $1\times10^5$ Pa to the two cylindrical rollers, wherein one of the cylindrical rollers which contacts the toner image has a thickness not greater than 1.0 mm.

20. A process cartridge for an image forming apparatus, comprising:

an image bearing member configured to bear an electrostatic latent image thereon; and a developing device configured to develop the electrostatic latent image with a developer comprising a toner to form a toner image on the image bearing member, wherein the toner is the toner according to claim 1.

21. The toner according to claim 1, including no carbon black.

22. The toner according to claim 1, wherein the crystalline polyester is present in an amount of from 3 to 30% by weight based on the total weight of the binder resin.

23. The toner according to claim 1, wherein the crystalline polyester comprises reacted units of fumaric acid, 1,4-butanediol, and 1,6-hexanediol and the non-crystalline resin comprises reacted units of fumaric acid, terephthalic and trimellitic anhydride.

24. The toner according to claim 23, wherein the metal-containing material comprises Fe, Mn, Cu, and Ti.

25. The toner according to claim 1, wherein the crystalline polyester comprises reacted units of fumaric acid, succinic acid, ethylene glycol, and 1,6-hexanediol; the non-crystalline resin comprises reacted units of fumaric acid, terephthalic acid and trimellitic anhydride; and the metal-containing material comprises Fe and Ti.

26. The toner according to claim 1, wherein the black metal-containing material comprises an iron oxide and has a specific surface area of from 1.3 to 80 $m^2/g$.

27. A toner comprising:

a binder resin comprising a crystalline polyester and a non-crystalline resin;

a release agent; and a black metal-containing material having a saturation magnetization not greater than 50 emu/g;

wherein the crystalline polyester is present in an amount of no greater than 50% by weight based upon the total weight of the binder resin.

28. The toner according to claim 27, wherein the black metal-containing material has a color such that L*, a* and b* values of the color is not greater than 15, from−1.0 to 1.0 and from−1.0 to 1.0, respectively.

29. The toner according to claim 27, wherein the black metal-containing material is a titanium-containing iron oxide.

30. The toner according to claim 29, wherein the titanium-containing iron oxide includes titanium in an amount of from 10 to 45% by weight based on iron atom included in the titanium-containing iron oxide.

31. The toner according to claim 27, wherein the black metal-containing material has a specific surface area of from 1.5 to 30 $m^2/g$.

32. The toner according to claim 27, wherein the black metal-containing material has a true specific gravity of from 4.0 to 5.0.

33. A toner container containing the toner according to claim 27.

34. A method for fixing an image of the toner according to claim 27, comprising:

passing a support with the toner image thereon through a nip between two cylindrical rollers while applying a pressure not greater than $1\times10^5$ Pa to the two cylindrical rollers, wherein one of the cylindrical rollers which contacts the toner image has a thickness not greater than 1.0 mm.

35. An image forming method comprising:

developing an electrostatic latent image on an image bearing member with the toner according to claim 27 to form a toner image on the image bearing member;

transferring the toner image onto a receiving material optionally via an intermediate transfer member; and fixing the toner image on the receiving material by passing a support with the toner image thereon through a nip between two cylindrical rollers while applying a pressure not greater than $1\times10^5$ Pa to the two cylindrical rollers, wherein one of the cylindrical rollers which contacts the toner image has a thickness not greater than 1.0 mm.

36. A process cartridge for an image forming apparatus, comprising:

an image bearing member configured to bear an electrostatic latent image thereon; and a developing device configured to develop the electrostatic latent image with a developer comprising a toner to form a toner image on the image bearing member, wherein the toner is the toner according to claim 27.

37. The toner according to claim 27, wherein the crystalline polyester is present in an amount of from 3 to 30% by weight based on the total weight of the binder resin.

38. The toner according to claim 27, wherein the crystalline polyester comprises reacted units of fumaric acid, 1,4-butanediol, and 1,6-hexanediol and the non-crystalline resin comprises reacted units of fumaric acid, terephthalic and trimellitic anhydride.

39. A toner comprising:

a binder resin comprising a crystalline polyester and a non-crystalline resin;

a release agent; and a black metal-containing material having a saturation magnetization not greater than 50 emu/g;

wherein the crystalline polyester is present in an amount of from 3 to 30% by weight based upon the total weight of the binder resin.

40. The toner according to claim 39, wherein the black metal-containing material has a color such that L*, a* and b* values of the color is not greater than 15, from−1.0 to 1.0and from−1.0 to 1.0, respectively.

41. The toner according to claim 39, wherein the black metal-containing material is a titanium-containing iron oxide.

42. The toner according to claim 41, wherein the titanium-containing iron oxide includes titanium in an amount of from 10 to 45% by weight based on iron atom included in the titanium-containing iron oxide.

43. The toner according to claim 39, wherein the black metal-containing material has a specific surface area of from 1.5 to 30 $m^2/g$.

44. The toner according to claim 39, wherein the black metal-containing material has a true specific gravity of from 4.0 to 5.0.

45. A toner container containing the toner according to claim 39.

46. A method for fixing an image of the toner according to claim 39, comprising:

passing a support with the toner image thereon through a nip between two cylindrical rollers while applying a pressure not greater than $1\times10^5$ Pa to the two cylindrical rollers, wherein one of the cylindrical rollers which contacts the toner image has a thickness not greater than 1.0 mm.

47. An developing method comprising:

developing an electrostatic latent image on an image bearing member with the toner according to claim 39 to form a toner image on the image bearing member.

48. An image forming method comprising:

developing an electrostatic latent image on an image bearing member with the toner according to claim 39 to form a toner image on the image bearing member;

transferring the toner image onto a receiving material optionally via an intermediate transfer member; and fixing the toner image on the receiving material by passing a support with the toner image thereon through a nip between two cylindrical rollers while applying a pressure not greater than $1\times10^5$ Pa to the two cylindrical rollers, wherein one of the cylindrical rollers which contacts the toner image has a thickness not greater than 1.0 mm.

49. A process cartridge for an image forming apparatus, comprising:

an image bearing member configured to bear an electrostatic latent image thereon; and a developing device configured to develop the electrostatic latent image with a developer comprising a toner to form a toner image on the image bearing member, wherein the toner is the toner according to claim 39.

* * * * *